US006855676B2

(12) United States Patent
Li et al.

(10) Patent No.: US 6,855,676 B2
(45) Date of Patent: Feb. 15, 2005

(54) LUBRICANT FOR CONVEYOR SYSTEM

(75) Inventors: Minyu Li, Oakdale, MN (US); Kim Person Hei, Baldwin, WI (US); Amy Haupert, St. Paul, MN (US)

(73) Assignee: Ecolab., Inc., St. Paul, MN (US)

( * ) Notice: Subject to any disclaimer, the term of this patent is extended or adjusted under 35 U.S.C. 154(b) by 303 days.

(21) Appl. No.: 10/073,824

(22) Filed: Feb. 11, 2002

(65) Prior Publication Data

US 2003/0176302 A1 Sep. 18, 2003

(51) Int. Cl.[7] ..... C10M 129/16; C10M 129/26

(52) U.S. Cl. ..... 508/532; 508/175; 508/250; 508/562

(58) Field of Search ..... 508/532, 175, 508/562, 250

(56) References Cited

U.S. PATENT DOCUMENTS

| | | | | |
|---|---|---|---|---|
| 2,825,693 | A | | 3/1958 | Beaubien et al. |
| 3,350,346 | A | | 10/1967 | Maxson |
| 3,352,787 | A | | 11/1967 | Bodach |
| 3,372,117 | A | | 3/1968 | Jones et al. |
| 3,374,171 | A | | 3/1968 | Davis |
| 3,574,100 | A | | 4/1971 | Wetmore |
| 3,583,914 | A | | 6/1971 | Garvin |
| 3,672,977 | A | | 6/1972 | Dardoufas |
| 3,718,588 | A | | 2/1973 | Bellos |
| 3,847,828 | A | | 11/1974 | Latos |
| 3,860,521 | A | | 1/1975 | Aepli et al. |
| 3,871,837 | A | * | 3/1975 | Bedague et al. ..... 44/389 |
| 3,950,258 | A | | 4/1976 | Imai et al. |
| 4,027,512 | A | * | 6/1977 | Treat ..... 72/42 |
| 4,274,973 | A | | 6/1981 | Stanton et al. |
| 4,288,331 | A | * | 9/1981 | Shepley et al. ..... 252/8.81 |
| 4,289,671 | A | | 9/1981 | Hernandez |
| 4,414,121 | A | | 11/1983 | Aiello |
| 4,436,200 | A | | 3/1984 | Hodlewsky et al. |
| 4,521,321 | A | | 6/1985 | Anderson et al. |
| 4,595,519 | A | | 6/1986 | Takeno et al. |
| 4,604,220 | A | | 8/1986 | Stanton |
| 4,636,321 | A | | 1/1987 | Kipp et al. |
| 4,719,022 | A | | 1/1988 | Hyde |
| 4,752,527 | A | | 6/1988 | Sanzero et al. |
| 4,789,593 | A | | 12/1988 | Das |
| 4,839,067 | A | | 6/1989 | Jansen |
| 4,929,375 | A | | 5/1990 | Rossio et al. |
| 5,009,801 | A | | 4/1991 | Wider et al. |
| 5,062,979 | A | | 11/1991 | Scharf et al. |
| 5,073,280 | A | | 12/1991 | Rossio et al. |
| 5,141,802 | A | | 8/1992 | Parrinello et al. |
| 5,160,646 | A | | 11/1992 | Scheld |
| 5,174,914 | A | | 12/1992 | Gutzmann |
| 5,182,035 | A | | 1/1993 | Schmidt et al. |
| 5,244,589 | A | | 9/1993 | Liu et al. |
| 5,286,300 | A | | 2/1994 | Hnatin et al. |
| 5,334,322 | A | | 8/1994 | Williams, Jr. |
| 5,352,376 | A | | 10/1994 | Gutzmann |
| 5,391,308 | A | | 2/1995 | Despo |
| 5,559,087 | A | | 9/1996 | Halsrud et al. |
| 5,616,679 | A | | 4/1997 | Fies et al. |
| 5,672,401 | A | | 9/1997 | Anglin et al. |
| 5,681,628 | A | | 10/1997 | Niederst et al. |
| 5,723,418 | A | | 3/1998 | Person Hei et al. |
| 5,863,874 | A | | 1/1999 | Person Hei et al. |
| 5,935,914 | A | | 8/1999 | Theyssen et al. |
| 6,214,777 | B1 | | 4/2001 | Li et al. |
| 6,288,012 | B1 | * | 9/2001 | Li et al. ..... 508/113 |
| 6,342,470 | B1 | | 1/2002 | Aronson et al. |

FOREIGN PATENT DOCUMENTS

| | | |
|---|---|---|
| DE | 3324475 | 1/1985 |
| EP | 0 011 730 | 6/1980 |
| EP | 0 137 057 | 4/1985 |
| EP | 0 302 705 | 2/1989 |
| EP | 0 329 891 | 8/1989 |
| EP | 0 359 330 | 9/1989 |
| WO | 92/13049 | 8/1992 |
| WO | 92/130048 | 8/1992 |
| WO | 93/18121 | 9/1993 |
| WO | 01/12759 | 2/2001 |

OTHER PUBLICATIONS

US 5,863,871, 1/1999, Besse et al. (withdrawn).
BASF brochure entitled "Pluronic & Tetronic Block Copolymer Surfactants" (no date).

* cited by examiner

*Primary Examiner*—Jacqueline V. Howard
(74) *Attorney, Agent, or Firm*—Crompton, Seager & Tufte

(57) ABSTRACT

A method of lubricating conveyor tracks or belts is herein described wherein the lubricant composition contains a polyalkylene glycol polymer and a fatty acid; also described are methods of manufacture of such lubricant compositions in both concentrate and diluted form. The compositions may also comprise additional functional ingredients.

46 Claims, No Drawings

LUBRICANT FOR CONVEYOR SYSTEM

FIELD OF THE INVENTION

The invention pertains to a lubricant suitable for use on a conveyor system. More particularly, the invention pertains to a conveyor lubricant that increases the lubricity of moving conveyors by lubricating the tracks or belts.

BACKGROUND

In many industries, including, for example, the food and beverage processing industry, containers and other articles are transported from one location to another location by conveyors such as belt conveyors. In many such conveyor systems, a lubricating composition is used on the conveyor. One of the reasons that a lubricating composition is used is to facilitate movement and reduce the damage to the container resulting from mechanical impact between the containers and the rubbing action among the containers and between the containers and the belt. For example, occasionally in such systems, the containers are stopped on the conveyor due to a back up on the conveyor. While the containers are stopped, the belt is often still moved continuously. To facilitate the smooth transportation of the containers, a lubricating composition can be applied onto the surface of the conveyor belt and/or the containers.

There can be numerous challenges in providing lubricating composition for use on conveyors. One example of a potential challenge deals with the desire for a lubricant that can be used on a broad variety of materials. For example, conveyors can be made of plastic, metal, or other materials, and the articles and containers being transported can likewise be made of a broad variety of materials, for example plastic, metal, glass, cardboard, paper, and the like. It is desirable that a lubricant be useful in more than just one application with one type of container and/or conveyor material.

Additionally, there is a desire for lubricants for conveyors that provide lubricity while showing a reduced amount of detrimental effects on the conveyors or on the articles and/or containers being conveyed. For instance, in some applications, the containers, or portions of the conveyors are made of thermoplastic materials. In such applications, it is desirable that the lubricating composition used be thermoplastic compatible. For example, in some applications that use fatty acids to make fatty acid soaps for use in lubricants, a high level of alkali neutralizing agent is required in order to neutralize the fatty acid in an aqueous composition. The use of higher amounts of alkali neutralizing agent, such as hydroxides and certain amines, in fatty acid soap containing lubricants, significantly increases the alkalinity of the lubricants. The increased level of alkalinity contributes to and promotes stress cracking in some thermoplastic containers, for example PET containers. The increased level of alkalinity can also contribute to and promote removal of some printed materials, such as printed codes on containers.

The prior art offers a number of different compositions and methods for lubricating conveyor systems. Each of these different compositions and methods can have certain advantages and disadvantages. There is an ongoing need to provide alternative compositions and methods for lubricating conveyor systems.

SUMMARY

The invention relates to a composition and method of lubricating a conveyor system. Some example embodiments relate to a method of lubricating a conveyor system for transporting a container comprising the step of applying a lubricant composition to a surface of a belt or track of the conveyor, the lubricant composition comprising a polyalkylene glycol polymer or a derivative thereof, and a fatty acid. Additionally, some embodiments relate to the lubricant comprising such a composition.

Another example embodiment relates to a lubricant concentrate for a conveyor system comprising a polyalkylene glycol polymer or a derivative thereof, and a fatty acid. In some embodiments, the lubricant concentrate can optionally contain other functional ingredients.

Yet another example embodiment relates to a lubricating solution composition for a conveyor system. The lubricating solution composition comprises a solvent and a lubricant component comprising a polyalkylene glycol polymer or a derivative thereof, and a fatty acid. In some embodiments, the lubricant solution can also optionally contain other functional ingredients.

These and other embodiments will be apparent to those of skill in the art and others in view of the following detailed description of some embodiments. It should be understood, however, that this summary, and the detailed description illustrate only some examples of various embodiments, and are not intended to be limiting to the invention as claimed.

DETAILED DESCRIPTION OF SOME EMBODIMENTS

As discussed above, the invention generally relates to a lubricant composition, and a method of lubricating a conveyor using such a lubricant. In at least some embodiments, the lubricant comprises a polyalkylene glycol polymer, or derivative thereof, and a fatty acid. The lubricant can be a concentrate that can be used alone, or can be mixed with a solvent/diluent, such as water, to form a lubricant mixture. In addition, in some embodiments, the composition can optionally include additional active or functional ingredients or components that enhance the effectiveness of the composition as a lubricant, or enhance or provide other functional aspects to the composition.

It has been discovered that in at least some embodiments, the polyalkylene glycol polymer or derivatives thereof, provides fatty acid emulsification/solubilization activity. As such, formulations can be produced that include fatty acids, but have no need, or a reduced need for an alkali neutralizing agent for the fatty acid. In at least some embodiments, this provides for a conveyor lubricant that is effective as a lubricant on a variety of conveyor and/or container material types, and that is relatively low in alkalinity. In such embodiments, the low level of alkalinity reduces the likelihood of stress cracking due to the lubricant in some thermoplastic containers, for example PET containers.

Polyalkylene Glycol Polymer

The term "polyalkylene glycol polymer" includes polymers of alkylene oxides or derivatives and mixtures or combinations thereof. For example, in some embodiments, polyalkylene glycol polymers can include polymers of the following general formula, and derivatives thereof:

$$H—O—(RO)_x—H$$

wherein R is a linear or branched alkyl, and x is a positive integer, and in some embodiments is in the range of about 4 to 500 for low molecular weight polyalkylene glycol polymers, and in some embodiments up to about hundreds of thousand for high molecular weight polyalkylene glycol polymers. Some examples of commercially available lower molecular weight polyalkylene glycol polymers include Carbowax™ and Ucon™ products available from Union Carbide, and some examples of commercially available higher molecular weight polyalkylene glycol products include POLYOX™ products available from Union Carbide.

As is apparent from above, the term "polyalkylene glycol polymer" also can include derivatives of such polyalkylene glycol polymers. Some examples of such derivatives can include polyalkylene glycol polymers modified by substitution on one or more of the terminal hydroxyl groups. For example, one or more of the terminal hydroxyl groups can be substituted with alkyl or acyl groups to form an ether, or a carbonyl group to form an ester. Some examples of such derivatives include compounds of the following formulas:

$$R'—O—(RO)_x—H$$

$$R'—COO—(RO)_x—H$$

wherein R' is linear or branched alkyl or aryl, and in some embodiments is in the range of $C_1$–$C_{26}$ alkyl or aryl, in some embodiments is in the range of $C_2$–$C_{18}$ alkyl or aryl, and in some embodiments is in the range of $C_{12}$ to $C_{18}$ alkyl or aryl. Some specific examples of such ether and ester derivatives of polyalkylene glycol include: Ethal SA20, Polyoxyethylene (20) stearyl alcohol from Ethox Chemicals, Lumulse100-S, Polyethylene glycol 1000 monostearate from Lambent Technologies, myrj 45, Polyoxylene (8) stearate from Uniqema (ICI Surfactants).

The polyalkylene glycol polymer component can be in the form of a homopolymer, or mixtures or combinations of homopolymers, or can include copolymers, such as block or random copolymers, or mixtures of combinations of such copolymers, or can include mixtures or combinations of homopolymers and copolymers. In some examples, the polyalkylene glycol polymers range in molecular weight from about 200 to several million, in some embodiments from about 200 to about 100,000, in some embodiments from about 200 to about 20,000, and in some embodiments from about 200 to about 10,000. The polyalkylene glycol polymer components can be in liquid, paste or solid form.

In some particular embodiments, the polyalkylene glycol polymer includes homopolymers of polyethylene glycols, polypropylene glycols, or block and random copolymers of ethylene oxide and propylene oxide, and derivatives of mixtures of any of these. For example, block copolymers of ethylene oxide and propylene oxide are known in the art as nonionic surfactants and are commercially available. One example of a trade name for such block copolymers is Pluronics® and are manufactured by BASF.

One particular type of polyalkylene glycol polymer used in some embodiments includes ethylene oxide/propylene oxide copolymer wherein the polymer is prepared by the controlled addition of propylene oxide to the two hydroxyl groups of propylene glycol. Ethylene oxide is then added to sandwich this hydrophobe between hydrophilic groups, controlled by length to constitute from 10% to 80% (by weight) of the final molecule. This type of polymer is best illustrated by the following formula:

$$HO—(CH_2CH_2O)_x—(CH_2\overset{\overset{CH_3}{|}}{C}HO)_y—(CH_2CH_2O)_{x'}—H$$

The x, y, and x' in the formula have no definite integers, but depend on the amount of ethylene oxide and propylene oxide in the desired polymer. In this particular embodiment, ethylene oxide constitutes anywhere from 10 to 80 wt-%.

A second type of block copolymer in some embodiments is that prepared by adding ethylene oxide to ethylene glycol to provide a hydrophile of designated molecular weight. Propylene oxide is then added to obtain hydrophobic blocks on the outside of the molecule thereby creating another sandwich. The structure of this polymer is illustrated as follows:

$$HO—(\overset{\overset{CH_3}{|}}{C}H—CH_2O)_x—(CH_2CH_2O)_y—(\overset{\overset{CH_3}{|}}{C}H_2CH_2O)_x—H$$

The content of ethylene oxide can range from 10 to 80 wt-%.

In some specific embodiments, the block copolymers are those between the molecular weight range of 800 to 40,000 and comprise polypropylene oxide sandwiched by polyethylene oxide blocks wherein the ethylene oxide constitutes from about 10 to 80 wt-% of a copolymer. One particular example of a useful block copolymer is that polymer identified as Pluronic® F-108, which has an average molecular weight of 14,600, a meltlpour point of 57° C., is a solid at room temperature with a viscosity of 2,800 cps at 77° C. and a surface tension in dynes/cm of 41 at 25° C., @0.1%.

The polyalkylene glycol component can comprise a very broad range of weight percent of the entire composition, depending upon the desired properties. For example, for concentrated embodiments, the polyalkylene glycol polymer can comprise in the range of 1 to about 99 wt.-% of the total composition, in some embodiments in the range of about 1 to about 50 wt.-% of the total composition, in some embodiments in the range of about 5 to about 25 wt.-% of the total composition, and in some embodiments in the range of about 10 to about 25 wt.-% of the total composition. For some diluted or use concentration, the polyalkylene glycol polymer can comprise in the range of 0.001 to about 99 wt.-% of the total composition, in some embodiments in the range of about 0.001 to about 50 wt.-% of the total composition, in some embodiments in the range of about 0.005 to about 25 wt.-% of the total composition, and in some embodiments in the range of about 0.01 to about 25 wt.-% of the total composition.

Fatty Acid

The term "fatty acid" includes any of a group of carboxylic acids that can be derived from or contained in an animal or vegetable fat or oil. Fatty acids are composed of a chain of alkyl groups and characterized by a terminal carboxyl group. The alkyl groups can be linear or branched. The fatty acid can be saturated or unsaturated. In some embodiments, the chain of alkyl groups contain from 4 to 24 carbon atoms, in some embodiments from 6 to 24 carbon atoms, and in some embodiments from 12 to 18 carbon atoms. The lubricant composition can include combinations or mixtures of different fatty acids. One particular fatty acid that is suitable is oleic acid, but as set fourth above, a broad variety of other fatty acids or combinations or mixtures thereof are contemplated for use.

In at least some embodiments, at least a portion of the fatty acid remains a free fatty acid, in that it is not neutralized. In some embodiments, substantially all of the fatty acid remains a free fatty acid. As discussed above, in some previous lubricants, the use of a fatty acid component required the use of an alkali neutralizing agent, for example to neutralize the fatty acid into a fatty acid soap. Such alkali neutralizing agents would undesirably increase the alkalinity content of the lubricant. Embodiments of the invention that include a reduced amount of such neutralizing agent, or do not include any such neutralizing agents, however, can be formulated such they do not include undesirable levels of alkalinity. For example, in some embodiments, the level of the total alkalinity is 100 ppm or less, and in some embodiments, the level of the alkalinity is 50 ppm or less. In some embodiments, such levels of alkalinity are in the use compositions, while a concentrated composition prior to dilution into a use composition may have higher levels of alkalinity.

The fatty acid component can comprise up to about 50% by wt. of the final lubricant composition. For example, the lubricant concentrate composition can comprise, in the range of 0.1 to about 50 wt. % fatty acid component, in some embodiments in the range of about 0.1 to about 20% wt. % fatty acid component, and in some embodiments in the range of about 0.1 to about 10 wt. % fatty acid component. Some examples of dilute or use lubricant compositions can comprise, in the range of 0.0001 to about 50 wt. % fatty acid component, in some embodiments in the range of about 0.0001 to about 20% wt. % fatty acid component, and in some embodiments in the range of about 0.0001 to about 10 wt. % fatty acid component.

Other Ingredients

Other active ingredients may optionally be used to improve the effectiveness of the lubricant. Some non-limiting examples of such additional active ingredients can include: surfactants, (cationic, anionic, amphoteric, and nonionic), neutralizing agents, stabilizing/coupling agents, dispersing agents, anti-wear agents, anti-microbial agents, foam inhibiters/generators, viscosity modifiers, sequestrants/chelating agents, bleaching agents such as hydrogen peroxide and others, dyes, odorants, and the like, and other ingredients useful in imparting a desired characteristic or functionality in the lubricant composition. The following describes some examples of such ingredients.

Surfactants

The lubricant concentrate may also contain surfactants, cationic, anionic, amphoteric, and nonionic, or mixtures thereof. For a discussion on surfactants, see Kirk-Othmer, Surfactants in Encyclopedia of Chemical Technology, 19:507–593 (2d Ed. 1969), which is incorporated by reference herein.

Some examples of anionic surfactants suitable for use include carboxylates, sulfates, sulfonates, phosphates, and mixtures thereof. Some examples of phosphates include alkyl orthophosphates such as stearyl acid phosphate, alkyl polyphosphates and alkyl ether phosphate (alkyl phosphate ester). Some phosphate esters have alkyl chains with 8 to 16 carbon atoms. In some embodiments, the phosphate is a linear alcohol alkylate phosphate ester, particularly a $C_8$ to $C_{10}$ alcohol ethoxylate phosphate ester. Some embodiments include alkaline salts of $C_8$–$C_{10}$ saturated and unsaturated fatty acids, such as, for example, tall oil, oleic or coconut oil. One particular example includes a sodium tall oil soap. When used in the lubricant composition, in some embodiments the anionic surfactant can be present in a range of up to about 50 wt-%.

Some examples of cationic cosurfactants suitable for use include quaternary ammonium surfactants with one or two long chain fatty alkyl groups and one or two lower alkyl or hydroxyalkyl substituents. Preferable examples are alkylbenzyl dimethyl ammonium chloride wherein the alkyl groups are a stearyl, tallow, lauryl, myristyl moiety, and the like, and mixtures thereof When used in the lubricant composition, in some embodiments the cationic cosurfactants can be present in a range of up to about 50 wt-%.

Some examples of nonionic surfactants include polyalkylene oxide condensates of long chain alcohols such as alkyl phenols and aliphatic fatty alcohols. Some specific examples contain alkyl chains of $C_6$ to $C_{18}$. Typical examples are polyoxyethylene adducts of tall oil, coconut oil, lauric, stearic, oleic acid, and the like, and mixtures thereof. Other nonionic surfactants can be polyoxyalkylene condensates of fatty acid amines and amides having from about 8 to 22 carbon atoms in the fatty alkyl or acyl groups and about 10 to 40 alkyloxy units in the oxyalkylene portion. An exemplary product is the condensation product of coconut oil amines and amides with 10 to 30 moles of ethylene oxide. It is possible to form a block copolymer by condensing different alkylene oxides with the same fatty acid amine or amide. An example is a polyoxalkylene condensate of a long chain fatty acid amine with three blocks of oxyalkylene units wherein the first and third block consists of propylene oxide moiety and the second block consists of ethylene oxide moiety. The block copolymer may be linear or branched.

Yet another kind of nonionics are alkoxylated fatty alcohols. Typical products are the condensation products of n-decyl, n-dodecyl, n-oxtadecyl alcohols, and a mixture thereof with 3 to 50 moles of ethylene oxide.

Some specifically suitable nonionics for the present lubricant compositions are alkylene oxide adducts of relatively low degree of polymerization alkylglycosides. These oxyalkylated glycosides comprise a fatty ether derivative of a mono-, di-, tri-, etc. saccharide having an alkylene oxide residue. Preferable examples contain 1 to 30 units of an alkylene oxide, typically ethylene oxide, 1 to 3 units of a pentose or hexose, and an alkyl group of a fatty group of 6 to 20 carbon atoms. An oxyalkylated glycoside compares with the general formula of:

$$H—(AO)_m—G_y—O—R$$

where AO is an alkylene oxide residue; m is the degree of alkyl oxide substitution having an average of from 1 to about 30, G is a moiety derived from a reducing saccharide contain 5 of 6 carbon atoms, i.e. pentose or hexose; R is saturated or nonsaturated fatty alkyl group containing 6 to 20 a carbon atoms; and y, the degree of polymerization (D.P.) of the polyglycoside, represents the number of monosaccharide repeating units in the polyglycoside, is an integer on the basis of individual molecules, but may be an noninteger when taken on an average basis when used as an ingredient for lubricants.

Some specific examples include sorbitan fatty acid esters, such as the Spans® and the polyoxyethylene derivatives of sorbitan and fatty acid esters known as the Tweens®. These are the polyoxyethylene sorbitan and fatty acid esters prepared from sorbitan and fatty esters by addition of ethylene oxide. Some specific examples of these are polysorbate 20, or polyoxyethylene 20 sorbitan monolaurate, polysorbate 40, or polyoxyethylene 20 sorbitan monopalmatate, polysorbate 60, or polyoxyethylene 20 sorbitan monostearate, or polysorbate 85, or polyoxyethylene 20 sorbitan triolyate. Used in the lubricant composition, in some embodiments the nonionic surfactant can be present in a range of up to about 50 wt-%.

Alliteratively, in some embodiments, the lubricant can include a nonionic surfactant that is an alkylpolyglycoside. Alkylpolyglycosides (APGs) also contain a carbohydrate hydrophile with multiple hydroxyl groups.

APGs are fatty ether derivatives of saccharides or polysaccharides. The saccharide or polysaccharide groups are mono-, di-, tri-, etc. saccharides of hexose or pentose, and the alkyl group is a fatty group with 7 to 20 carbon atoms. Alkylpolyglycoside can be compared with the general formula of:

$G_x$—O—R where G is moiety derived from a reducing saccharide contain 5 of 6 carbon atoms, i.e. pentose or hexose; and R is saturated or nonsaturated fatty alkyl group containing 6 to 20 carbon atoms; x, the degree of polymerization (D.P.) of the polyglycoside, representing the number of monosaccharide repeating units in the polyglycoside, is an integer on the basis of individual molecules, but may be a noninteger when taken on an average basis when used as an ingredient for lubricants. In some embodiments, x has the value of less than 2.5, and in some embodiments is in the range or 1 and 2.

The reducing saccharide moiety, G can be derived from pentose or hexose. Exemplary saccharides are glucose, fructose, mannose, galactose, talose, gulose, allose, altrose, idose, arabinose, xylose, lyxose and ribose. Because of the ready availability of glucose, glucose is a common embodiment in the making of polyglycosides.

The fatty alkyl group in some embodiments is a saturated alkyl group, although unsaturated alkyl fatty group can be used. It is also possible to use an aromatic group such as alkylphenyl, alkylbenzy and the like in place of the fatty alkyl group to make an aromatic polyglycoside.

Generally, commercially available polyglycosides have alkyl chains of $C_8$ to $C_{16}$ and average degree of polymerization in the range of 1.4 to 1.6. In some embodiments, a lubricant composition of the invention can include up to about 50 wt-%, and in some embodiments in the range of about 3 wt-% to 10 wt-% of alkylpolyglycoside.

Neutralizing Agents

The lubricating composition can also include a neutralizing agent for various purposes. For example, to neutralize a portion of the fatty acid component. Additionally, many surfactants are most effective in the neutral pH range. Moreover, acid conditions might lead to chemical attack on certain thermoplastics and metal parts. Therefore, in some embodiments, a portion of the fatty acid component, or the available acid from the surfactants employed, e.g. the phosphates, is neutralized. However, in some embodiments, as discussed above, it is desirable to provide a composition with a relatively low level of alkalinity, for example, in compositions for use with certain thermoplastic containers or conveyors, such as PET containers. Therefore, in such embodiments, relatively low levels of alkali neutralizing agent is used. For example, in some embodiments, the level of the total alkalinity at diluted or use concentration is 100 ppm or less, and in some embodiments, the level of the alkalinity is 50 ppm or less. For example, in some embodiments, the alkalinity can be calculated as percent $CaCO_3$ at diluted or use concentration, as described in the examples below. In some embodiments, a diluted use solution can have total alkalinity levels in these ranges, while the concentrated composition prior to dilution can have higher levels of alkalinity.

Some commonly used neutralizing agents are the alkaline metal hydroxides such as potassium hydroxide and sodium hydroxide. Another class of neutralizing agent is the alkyl amines, which may be primary, secondary, or tertiary or, alkanolamines, such as monoethanolamine, diethanolamine and triethanolamine, or cyclic amines such as morpholine.

Fatty alkyl substituted amines can also be used as neutralizing agents wherein the first substitute group of the amine is a saturated or unsaturated, branched or linear alkyl group having between 8 to 22 carbon atoms, alkyl group or hydroxyalkyl group having 1 to 4 carbons, or an alkoxylate group, and the third substitute group of the amine is an alkylene group of 2 to 12 carbons bonded to a hydrophilic moiety, such as —$NH_2$, —OH, $SO_3$, amine alkoxylate, alkoxylate, and the like. These amines can be illustrated by the formula:

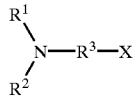

wherein $R_1$ is an alkyl group having between 8 to 22 carbon atoms, and $R_2$ is a hydrogen, alkyl group or hydroxyalkyl group having 1 to 4 carbons or an alkoxylate group, $R_3$ is an alkylene group having from 2 to 12 carbon atoms, and X is a hydrogen or a hydrophilic group such as —$NH_2$, —OH, —$SO_3$, amine alkoxylate, amine alkoxylate, alkoxylate, and the like.

Examples of amines useful for neutralization are: dimethyl decyl amine, dimethyl octyl amine, octyl amine, nonyl amine, decyl amine, ethyl octyl amine, and the like, and mixtures thereof.

When X is —$NH_2$, preferable examples are alkyl propylene amines such as N-coco-1,3,diaminopropane, N-tallow-1,3,diaminopropane and the like, or mixtures thereof.

Examples of preferable ethoxylated amines are ethoxylated tallow amine, ethoxylated coconut amine, ethoxylated alkyl propylene amines, and the like, and mixtures thereof.

Generally, when added into the lubricant concentrate, the neutralizing agent is present in the range of about 20% by weight or less, and in some embodiments, less than 5% % by weight.

Though a lubricant concentrate can be formulated with pH in a wide alkaline or acidic range, in some embodiments, the pH of the composition is in the range of about 4.5 and 10, and in some embodiments is in the range of about 5 and 9.

Stabilizing/coupling agents

In a lubricant concentrate, stabilizing agents, or coupling agents can be employed to keep the concentrate homogeneous, for example, under cold temperature. Some of the ingredients may have the tendency to phase separate or form layers due to the high concentration. Many different types of compounds can be used as stabilizers. Examples are isopropyl alcohol, ethanol, urea, octane sulfonate, glycols such as hexylene glycol, propylene glycol and the like. The stabilizing/coupling agents can be used in an amount to give desired results. This amount can range, for example, from about 0 to about 30 wt.-% of the total composition.

Detergents/Dispersing agents

Detergents of dispersing agents may also be added. Some examples of detergents and dispersants include alkylbenzenesulfonic acid, alkylphenols, carboxylic acids, alkylphosphonic acids, and their calcium, sodium, and magnesium salts, polybutenylsuccinic acid derivatives, silicone surfactants, fluorosurfactants, and molecules containing polar groups attached to an oil-solubilizing aliphatic hydrocarbon chain.

Some examples of suitable dispersing agents include triethanolamine, alkoxylated fatty alkyl monoamines and diamines such as coco bis (2-hydroxyethyl)amine, polyoxyethylene(5-)coco amine, polyoxyethylene(15)coco amine, tallow bis(-2hydroxyethyl)amine, polyoxyethylene (15)amine, polyoxyethylene(5)oleyl amine and the like.

The detergent and/or dispersants can be used in an amount to give desired results. This amount can range, for example, from about 0 to about 30 wt.-% of the total composition.

Anti-wear agents

Anti-wear agents can also be added. Some examples of anti-wear agents include zinc dialkyl dithiophosphates, tricresyl phosphate, and alkyl and aryl disulfides and polysulfides. The anti-wear and/or extreme pressure agents are used in amounts to give the desired results. This amount can range, for example, from 0 to about 20 wt.-% of the total composition.

Anti-microbial agents

Anti-microbial agents can also be added. Some useful anti-microbial agents include disinfectants, antiseptics, and preservatives. Some non-limiting examples include phenols including halo- and nitrophenols and substituted bisphenols such as 4-hexylresorcinol, 2-benzyl-4-chlorophenol and 2,4,4'-trichloro-2'-hydroxydiphenyl ether, organic and inorganic acids and its esters and salts such as dehydroacetic acid, peroxycarboxylic acids, peroxyacetic acid, methyl p-hydroxy benzoic acid, cationic agents such as quaternary ammonium compound, phosphonium compounds such as tetrakishydroxymethyl phosphonium sulphate (THPS), aldehydes such as glutaraldehyde, antimicrobial dyes such as acridines, triphenylmethane dyes and quinines and halogens including iodine and chlorine compounds. The antimicrobial agents can be used in amounts to provide the desired antimicrobial properties. In some examples, the amount can range from 0 to about 20 wt.-% of the total composition.

Foam inhibiters/generators

Foam inhibitors or foam generators can also be used. Some examples of foam inhibitors include methyl silicone polymers. Some examples of foam generators include surfactants such as non-ionic, cationic, and amphoteric compounds. The foam inhibitors/generators can be used in amounts to provide the desired results. The foam modifiers can be used in an amount to give desired results. This amount can range, for example, from about 0 to about 30 wt.-% of the total composition.

Viscosity modifiers

Viscosity modifiers can also be used. Some examples of viscosity modifiers include pour-point depressants and viscosity improvers, such as polymethacrylates, polyisobutylenes polyacrylamides, polyvinyl alcohols, polyacrylic acids, high molecular weight polyoxyethylenes, and polyalkyl styrenes. The modifiers can be used in amounts to provide the desired results. In some embodiments, the viscosity modifiers can range for 0 to about 30 wt.-% of the total composition.

Sequestrants

In addition to the aforementioned ingredients, it is possible to include other chemicals in the lubricant concentrates. For example, where soft water is unavailable and hard water is used for the dilution of the lubricant concentrate, there is a tendency for the hardness cations, such as calcium, magnesium, and ferrous ions, to reduce the efficacy of the surfactants, and even form precipitates when coming into contact with ions such as sulfates, and carbonates. Sequestrants can be used to form complexes with the hardness ions. A sequestrant molecule may contain two or more donor atoms which are capable of forming coordinate bonds with a hardness ion. Sequestrants that possess three, four, or more donor atoms are called tridentate, tetradentate, or polydentate coordinators. Generally the compounds with the larger number of donor atoms are better sequestrants. The preferable sequestrant is ethylene diamine tetracetic acid (EDTA), such as Versene products which are $Na_2EDTA$ and $Na_4EDTA$ sold by Dow Chemicals. Some additional examples of other sequestrants include: iminodisuccinic acid sodium salt, trans-1,2-diaminocyclohexane tetracetic acid monohydrate, diethylene triamine pentacetic acid, sodium salt of nitrilotriacetic acid, pentasodium salt of N-hydroxyethylene diamine triacetic acid, trisodium salt of N,N-di(beta-hydroxyethyl)glycine, sodium salt of sodium glucoheptonate, and the like.

Lubricant Composition and Use

The composition as a concentrate can either be a liquid or a solid depending on the choice and concentrations of raw materials. Although lubricants can be manufactured and sold in dilute form, they are often sold as concentrates because of the ease of handling and shipping cost. A lubricant concentrate may be substantially solid, having less than about 1 wt-% of a carrier fluid for carrying the various ingredients of the lubricant.

In some embodiments it is preferable that the lubricant concentrate have a carrier fluid. The carrier fluid aids in the dispensing and dilution of the concentrate in water before application on the conveyor belt and thermoplastic containers. Water is the most commonly used and preferred carrier for carrying the various ingredients in the formulation of the lubricant concentrate. It is possible, however, to use a water-soluble solvent, such as alcohols and polyols. These solvents may be used alone or with water. Some example of suitable alcohols include methanol, ethanol, propanol, butanol, and the like, as well as mixtures thereof. Some examples of polyols include glycerol, ethylene glycol, propylene glycol, diethylene glycol, and the like, as well as mixtures thereof. Generally, when added into the lubricant concentrate, the carrier is present in the range of about 1% to 90% by weight. When the lubricant is diluted in water for applying to a belt, water may be present in the diluted lubricating solution in the range of about 50% to 99.9 wt-%.

In some embodiments, the lubricant concentrate is diluted with water in a concentrate/water ratio of 1:50 to 1:1000 before using. In another aspect, a method of lubricating a continuously-moving plastic conveyor system for transporting a container is practiced by applying diluted aqueous thermoplastic compatible lubricating composition to the surface of the plastic conveyor. This application may be by means of spraying, immersing, brushing and the like. The dilution may be done either batchwise by adding water into a container with a suitable amount of the concentrate or continuously online. Online dilution is usually done by the regulated injection of a stream of concentrate into a stream of water at a steady rate. The injection of the concentrate can be achieved by a pump, for example, metering pump, although other injection means are possible. Water of varying quality, for example, tap water, soft water, and deionized water may be used. The water may also be heated.

In some other embodiments, the compositions can be applied in relatively low amounts, and do not require dilution with significant amounts of a carrier. In some such embodiments, the composition provides a thin, substantially non-dripping lubricating film. In contrast to dilute embodiments, such embodiments can provide drier lubrication of the conveyors, and/or containers, a cleaner and drier conveyor line and working area, and reduced lubrication usage, thereby reducing waste, cleanup, and disposal problems.

In yet some additional embodiments, it may be desirable to provide one or more or the various components of the composition in separate containers until it is desired to make the final composition. For example, the polyalkylene glycol polymer component and the fatty acid component can be provided in separate containers until it is desired to make the composition. Such an arrangement allows for the separate components to be available for use in other compositions. For example, the polyalkylene glycol polymer component could be useful in a separate lubricant composition that does not include the fatty acid component. Likewise, the fatty acid component could be useful in a separate lubricant composition that does not include the polyalkylene glycol polymer component. By maintaining such components in separate containers until it is desired to combine them to make the lubricant composition containing both, the components are potentially available for use in other systems. The mixing of the components can be made in concentrates or mixed after dilution. The mixing of the dilution can be made at the point of application or before at the mechanical system of transporting the product to the intent use sites.

The lubricant composition, either concentrated or diluted, and in a solid, paste or liquid form can be applied to a conveyor system surface that comes into contact with containers, the container surface that needs lubricity, or both. Any suitable method of applying the lubricant to the conveyor surface and/or the container surface can be used. Some examples of application methods include spraying, wiping, rolling, brushing, atomizing, dipping, and the like, or a combination of any of these. The lubricant composition can be applied to the surface by continuous, intermittent, or one time application. In at least some embodiments, only portions of the conveyor that contacts the containers needs to be treated. Likewise, in some embodiments, only portions of the container that contacts the conveyor, or in some embodiments, that contacts other containers, needs to be treated. The lubricant can be formulated as a permanent composition that remains on the container or conveyor throughout its useful life, or can be a semi-permanent, or temporary composition.

The surface of the conveyor that supports the containers can be made of a wide variety of materials, for example, fabric, metal, plastic, elastomer, composites, or combinations or mixtures of these materials. Any type of conveyor system used in the container field can be treated according to some embodiments of the invention. Some examples of conveyors, containers, methods of application, and the like are disclosed in International Patent Application publication number WO 01/12759, the entire disclosure of which is incorporated herein by reference for all purposes.

In some embodiments, the lubricant composition can also be formulated to include additional desirable characteristics. For example, it may be desirable to provide a lubricating composition that is has biodegradability and nontoxicity. The public is increasingly aware of the ecological problems caused by the release of man-made chemicals in the environment. More stringent governmental regulations are being implemented to respond to this public concern. Therefore, in some embodiments, the lubricating composition would desirably contain chemicals that are more biodegradable and less toxic than conventional chemicals used in lubricant concentrates. In some embodiments, it may also be desirable that the lubricating composition be compativle with inks or dyes that are used on the surface of the containers. For example, it may be desirable that the lubricant composition be compatible with inks used for date code on some containers, and does not remove such ink from the containers.

For a more complete understanding of the invention, the following examples are given to illustrate some embodiment. These examples and experiments are to be understood as illustrative and not limiting. All parts are by weight, except where it is contrarily indicated.

EXAMPLES

The following chart provides a brief explanation of certain chemical components used in the following examples:

Trade names and corresponding description of some chemicals used in the examples:

| Trademark/ Chemical name | Description | Providers |
|---|---|---|
| Pluronic F108 | EO-PO-EO block copolymer | BASF |
| Ucon 50HB660 | EO-PO copolymer, equal wt | Union Carbide |
| Carbowax 300 | Polyethylene glycol | Union Carbide |
| 75-HB1400 | EO-PO copolymer, 75% EO | Union Carbide |
| Ethal SA20 | PEO (20) stearyl alcohol | Ethox Chemcals |
| Neodox 25-11 | Alcohol Ethoxycarbonate | Hickson DanChem |
| Oleic acid | | Henkel |
| Morpholine | | Eastman |
| $Na_2EDTA$ | Disodium salt of ethylenediaminetetraacetic acid | Dow Chemical |
| Lumulse 100-S | Polyethylene glycol monostearate | Lambent Technologies |
| Aerosol OT | Dioctyl sodium sulfosuccinate | Cytec Industries Inc |

Additionally, in some of the following examples, the lubricity of some of the lubricants was determined using the following two testing methods:

Slider Lubricity Test

In the slider tests, the lubricity of testing samples was done by measuring the drag force (frictional force) of a weighted cylinder riding on a rotating disc, wetted by the testing sample. The material for the cylinder is chosen to coincide with the container materials, e.g., glass, PET, or mild steel. Similarly the material of the rotating disc is the same as the conveyor, e.g., stainless steel or plastic. The drag force, using an average value, is measured with a solid state transducer, which is connected to the cylinder by a thin flexible string. The weight of the cylinder made from the same material is consistent for all measurements.

The relative coefficient of friction (Rel. COF) can then be calculated and used, where:

Rel. COF=COF(sample)/COF(reference)=drag force(sample)/drag force(reference).

Short Track Test

In some of the following examples, the lubricity of the various lubricant compositions was measured using "short track" conveyor systems. The conveyor belt used was either a polyacetal plastic conveyor belt or a stainless steel conveyor belt, as indicated in the results tables. The load containers were either PET (polyethyleneterephthalate) bottles or aluminum cans, as indicated in the results table. The conveyor is driven by a motor which is set at 30–100 ft/min. The lubricating composition being tested was applied on the conveyor track by spraying through a nozzle. Six to twenty four containers were stacked in a rack on the track. The rack is connected to a strain gauge by a wire. As the belt moves, force is exerted on the strain gauge by the pulling action of the rack on the wire. The pull strength is recorded by a computer. The test is run for certain time until it reaches stabilization. The coefficient of friction is calculated on the basis of the measured average force and the mass of the containers. Different lubricants are compared by the pull strength and coefficient of friction.

Example 1

Lubricity Improvement with a Composition Containing Pluronic F108 and Fatty Acid The following table shows two compositions that were prepared by admixing the listed ingredients in the appropriate wt.-% as shown. Formula A includes a polyalkylene glycol polymer component (Pluronic F108) without a fatty acid component, while Formula B includes both a polyalkylene glycol polymer component (Pluronic F108) and a fatty acid component (oleic acid).

| Component | Formula A (wt % in formula) | Formula B (wt % formula) |
|---|---|---|
| Pluronic F108 | 14.8% | 14.4% |
| Neodox 25-11 | 10.2% | 10% |
| NaOH | 1.1% | 1.1% |
| Oleic acid | 0% | 2.5% |
| DI H2O | 73.9% | 72% |

Each of these formulations was then diluted with deionized water to a 0.1% deionized water solution, and the lubricity was then tested using the Slider Lubricity Test as discussed above. The results are shown in the following table.

Slider results:

| | Formula A | Formula B |
|---|---|---|
| Ave. drag force (g), M/M | 48.35 | 20.45 |
| Ave. drag force (g), G/M | 53.5 | 29.5 |
| Ave. drag force (g), P/M | 28.45 | 27.25 |

M/M = mild steel cylinder on stainless steel disc.
G/M = glass cylinder on stainless steel disc
P/M = PET cylinder on stainless steel disc In the slider test, lower drag force indicates a better lubricity. Therefore, the results indicated that Formula B, which includes a of combination of fatty acid with Pluronic F108 has significant increased lubricity for mild steel on stainless steel surface lubrication and for glass on stainless steel surface lubrication in comparison to Formula A.

Example 2

Lubricants with Low Alkalinity and Lubricities on Metal and Plastic Surfaces In this example, two formulations were prepared—Formula C including a Morpholine component as a neutralizing agent for partial neutralization of the fatty acid component, and Formula D having no neutralizing agent. The following table shows the two compositions that were prepared by admixing the listed ingredients in the appropriate wt.-% as shown.

Formulas

| Formula C (with partial neutralization) | wt % | Formula D (with zero neutralization) | wt % |
|---|---|---|---|
| Pluronic F108 | 12.00% | Pluronic F108 | 12.00% |
| Ucon 50 HB660 | 5.00% | Ucon 50 HB660 | 5.00% |
| Carbowax 300 | 3.00% | oleic acid | 2.50% |
| oleic acid | 2.50% | $H_2O$ | 78.25% |
| $H_2O$ | 76.5% | Aerosol OT | 2.25% |
| Morpholine | 0.50% | $Na_2EDTA$ | 0.50% |
| $Na_2EDTA$ | 0.50% | | |

Each of these formulations was then diluted with deionized water to a 1% deionized water solution, and the total alkalinity and pH of the two formulations was then measured and the solution appearance was noted. The alkalinity was determined by titrating the solutions with HCl solution and calculating the total alkalinity as $CaCO_3$ using the following formula:

$$\% \text{ alkalinity as } CaCO_3 = \frac{(\text{mls HCl to pH 4.0})(\text{N HCL})}{(\text{g Sample titrated})} \times \frac{100.1}{2} \times \frac{100}{1000}$$

The results are provided in the following table.

Alkalinity, pH, and solution appearance of the formulas at 1%:

| | Formula C | Formula D |
|---|---|---|
| solution appearance | clear | clear |
| pH at 1% | 8 | 5 |
| Alkalinity as $CaCO_3$ (ppm) at 1% | 35 | <10 |

This data demonstrated that lubricant compositions with low alkalinity at use concentrations (usually at or below 1%) can be obtained by combining fatty acid with polyalkyl glycols, with or without partial neutralization. The alkalinity of the formulas meets the ISBT (International Society of Beverage Technologists) PET Stress Crack Committee recommendation requirement of less than 100 ppm at use concentration.

The lubricity of the above formulations, along with a commercially available lubricant (Lubodrive-Rx) was then measured using the Short Track testing method described above. Lubodrive-Rx is a commercially available conveyor lubricant from Ecolab. The product is suitable for both PET bottle and aluminum can lubrications on plastic and metal surfaces. The results are shown in the following table.

| Lubricant Formulation | PET on Stainless Steel COF | Can on Plastic COF | Can on Stainless Steel COF | PET on Plastic COF |
|---|---|---|---|---|
| Lubodrive-Rx | 0.18 | 0.12 | 0.16 | 0.14 |
| Formula C | 0.16 | 0.11 | 0.12 | 0.12 |
| Formula D | 0.16 | 0.12 | 0.11 | 0.12 |

The above results demonstrated that lubricant compositions with good lubricities on both plastic and metal surfaces can be obtained by combining fatty acid with polyalkyl glycols, with or with out partially neutralization.

Example 3

Oleic Acid Emulsification Power Comparison Among Several Polyalkylene Glycols and One Polyalkylene Glycol Derivative In this example, several test solutions of various polyalkylene glycols and one polyalkylene glycol derivative were prepared and the fatty acid emulsification power of each was measured. In this procedure, 25 g of the testing solution which contains 18% of the emulsifier (PAG or PAG derivative) in deionized water was mixed well with 1.0 g (0.00355 mol) of oleic acid. To the mixture, under stir, morpholine was slowly added until the mixture turned to a clear solution. The amount of morpholine used for neutralization was recorded for the comparison. A higher amount of morpholine used indicates that the testing agent had less emulsifier power for oleic acid. The results are shown in the following table.

| Emulsifier | Structure | Average molecular wt. | Morpholine used Wt (g) | Morpholine used mol |
|---|---|---|---|---|
| Pluronic F108 | EO-PO-EO block copolymer | 14600 | 0.33 | 0.00379 |
| Ucon 50HB660 | EO-PO copolymer, equal wt | 1590 | 0.27 | 0.003099 |
| Carbowax 300 | Polyethylene glycol | 300 | 1.2 | 0.0138 |
| 75-HB1400 | EO-PO copolymer, 75% EO | 2470 | 0.92 | 0.01056 |
| Ethal SA20 | PEO (20) stearyl alcohol | 1130 | 0.32 | 0.00367 |
| None | | | 0.70 | 0.00803 |

These results demonstrated some of the polyalkylene glycols and the polyalkylene glycol derivatives offer good fatty acid emulsifier power.

Example 4

Comparative Lubricity Evaluation with Slider

In this example, several formulations including a combination of oleic acid with polyalkylene glycol polymers, or polyalkylene glycol polymer derivatives with partially neutralization were compared with formulations including only polyalkylene glycol polymers, or polyalkylene glycol polymer derivatives and a commercially available lubricant. The formulations and results are shown in the following table.

| Sample # | Compositions (in DI $H_2O$) | Testing solution concentration in soft $H_2O$ | PET on stainless steel slider lubrication average drag force (g) |
|---|---|---|---|
| 1 | Lubodrive-Rx | 0.1% | 45.75 |
| 2 | 18% Pluronic F108 | 1% | 66 |
| 3 | 18% Ucon 50HB660 | 1% | 69 |
| 4 | 18% Carbowax 300 | 1% | 74.1 |
| 5 | 18% Ethal SA20 | 1% | 70.9 |
| 6 | 25 g of 18% Pluronic F108 1.0 g of oleic acid 0.33 g of morpholine | 0.1% | 36.45 |
| 7 | 25 g of 18% Ucon 50HB660 1.0 g of oleic acid 0.27 g of morpholine | 0.1% | 39.55 |
| 8 | 25 g of 18% Ethal SA20 1.0 g of oleic acid 0.32 g of morpholine | 0.1% | 34.5 |

The lower drag force indicates a better lubricity. The results demonstrated that, the combination of oleic acid with polyalkylene glycol polymers, or polyalkylene glycol polymer derivatives with partially neutralization showed significantly improved lubricity than polyalkylene glycol polymers, or polyalkylene glycol polymer derivatives themselves for PET on stainless steel lubrication. Additionally, the results show that the combination of fatty acid with polyalkylene glycol polymers, or polyalkylene glycol polymer derivatives with partially neutralization showed lubricity better than or equal to the commercially available lubricant.

Example 5

Effect of EO-PO-EO Block Copolymer with Partially Neutralized Fatty Acid

In this example, two formulations were prepared, Formulation E, which includes a polyalkylene glycol component (Pluronic F108) and a fatty acid component (oleic acid), and Formulation F, which includes the fatty acid component, but not a polyalkylene glycol component. The components of each formulation, and the product appearance is shown in the following table.

| Components | Formulation E Wt (g) | Formulation F Wt (g) |
|---|---|---|
| Pluronic F108 (18%) | 33.33 | 0 |
| oleic acid | 0.85 | 0.85 |
| $H_2O$ | 15.32 | 48.65 |
| Morpholine | 0.50 | 0.50 |
| Total | 50.00 | 50.00 |
| Product appearance | clear | haze |

The above results demonstrated that, in the presence of Pluronic F108, a clear solution containing fatty acid with partially neutralization can be obtained.

Example 6

Effect of Fatty Acid

In this Example, the lubricity of Formulation E from Example 5 above was compared with the lubricity of Formula G, which does not include a fatty acid component. The components of each formulation, and the product appearance is shown in the following table.

| Formulas | | |
|---|---|---|
| Components | Formula E Wt (g) | Formula G Wt (g) |
| F108 (18%) | 33.33 | 33.33 |
| oleic acid | 0.85 | 0 |
| H2O | 15.32 | 16.67 |
| Morpholine | 0.50 | 0 |
| Total | 50.00 | 50.00 |
| appearance | clear | clear |

The lubricity of these two formulations, along with a commercially available lubricant (Lubodrive-Rx), was then tested using the Slider test as discussed above. The results are shown in the following table.

Results:

| Conditions | % of actives in testing solution | Slider test | Average Drag force (g) |
|---|---|---|---|
| Formula E | 0.029% | P/M | 23.2 |
| | | M/M | 24.95 |
| | | M/P | 27.15 |
| | | P/P | 27.9 |
| Formula G | 0.024% | P/M | 48 |
| | | M/M | >50 |
| | | M/P | 35.75 |
| | | P/P | 39.15 |
| Lubodrive-RX | 0.031% | P/M | 44.15 |
| | | M/M | 28.1 |
| | | M/P | 22 |
| | | P/P | 27.9 |

M/M = mild steel on stainless steel
G/M = glass on stainless steel
P/M = PET on stainless steel The above lubricity results demonstrated that Formula E, containing oleic acid and the EO-PO-EO block copolymer with partially neutralization showed significant improvements in all surface lubrications over the EO-PO-EO block copolymer solution without fatty acid. Additionally, the Formula E containing oleic acid and the EO-PO-EO block copolymer with partially neutralization showed, in contrast to Lubodrive Rx, improved lubricities for PET and mild steel on stainless steel lubrication and comparable lubricities for mild steel and PET on plastic lubrications.

Example 7

PET Bottle Lubrication on Plastic and Metal Surfaces

The data below shows multiple formulas with varying concentration of components. These formulas were analyzed using the slider test discussed above, comparing the lubricity to a known lubricant, Lubodrive Rx (L-Rx). The formulas were tested with Plastic on Plastic conveyor and Plastic on Metal conveyor. The results indicate an adequate lubricity for all formulas Plastic on Plastic, however only one formula performs better than Lubodrive Rx for Plastic on Metal conveyor. This lubricant contains the combination of polyalkylene glycol polymer with fatty acid. The formulations are shown in the following table, wherein the numbers indicate wt.-% of the components in the composition.

| Formula number | 1 | 2 | 3 | 4 | 5 | 6 |
|---|---|---|---|---|---|---|
| Pluronic F-108 | 7 | 7 | 7 | 7 | 7 | 7 |
| Carbowax 300 | 7 | 7 | 7 | 7 | 7 | 7 |
| Lumulse 100-S | 1 | 2.5 | 5 | 7 | 7 | 0 |
| Water | 85 | 83.5 | 81 | 79 | 76.74 | 79 |
| Oleic Fatty Acid | 0 | 0 | 0 | 0 | 1.4 | 0 |
| Morpholine | 0 | 0 | 0 | 0 | 0.35 | 0 |
| Disodium EDTA | 0 | 0 | 0 | 0 | 0.51 | 0 |
| Ethal SA-20 | 0 | 0 | 0 | 0 | 0 | 7 |
| Total | 100 | 100 | 100 | 100 | 100 | 100 |

The formulations were then diluted in water and a slider test analysis was performed. All dilutions were made in soft water at 0.1%. The Slider Analysis results are shown in the following tables.

| | L-Rx | 1 | 2 | 3 | 4 | 5 | 6 | L-Rx |
|---|---|---|---|---|---|---|---|---|
| PET on Plastic | | | | | | | | |
| Average drag force (g) | 27.95 | 24.75 | 24.1 | 23.95 | 23.7 | 23.7 | 23 | 27.05 |
| PET on Metal | | | | | | | | |
| Average drag force (g) | 37.55 | 46.65 | 56.8 | 58.8 | 59.2 | 33.45 | 50.25 | 37.5 |

The above experiments demonstrated that, the combination of polyalkylene glycol polymer and fatty acid formula had good lubricity in both tests.

Example 8

Short Track Analysis

The following two formulas, M and N, were made and their lubricity was tested using a short track, as discussed above. The coefficient of friction was measured on the short track for plastic containers on plastic conveyor belts and plastic containers on metal conveyor belts. The two formulas are shown in the following table.

| Formula | M | N |
|---|---|---|
| Pluronic F-108 | 7 | 7 |
| Carbowax 300 | 7 | 7 |
| Water | 79 | 76.74 |
| Oleic Fatty Acid | 0 | 1.4 |
| Morpholine | 0 | 0.28 |
| Disodium EDTA | 0 | 0.51 |
| Ethal SA-20 | 7 | 7 |
| Total | 100 | 99.93 |

The results of the short track analysis are shown in the following table.

Lubricity Data from Short Track

| | Plastic on Plastic | Plastic on Metal |
|---|---|---|
| 0.1% Lubodrive Rx | 0.114 | 0.119 |
| 0.1% Formula M | 0.099 | 0.114 |
| 0.1% Formula N | 0.097 | 0.101 |

The two lubricants in comparison were very similar, however one lubricant (Formula N) contained an addition of Oleic Acid and neutralizer, while the other (Formula M) did not. The Formula N performed much better for Plastic on Metal conveyor, even better than the traditional lubricant already sold in the market, Lubodrive Rx (L-Rx).

The foregoing summary, detailed description, and examples provide a sound basis for understanding the invention, and some specific example embodiments of the invention. Since the invention can comprise a variety of embodiments, the above information is not intended to be limiting. The invention resides in the claims.

What is claimed is:

1. A method of lubricating a conveyor system for transporting a container, the method comprising:

applying a lubricant composition to a surface of a belt or track of the conveyor, the lubricant composition comprising:

a polyalkylene glycol polymer or a derivative thereof; and a fatty acid.

2. The method of claim 1, wherein the polyalkylene glycol polymer or a derivative thereof comprises in the range of about 0.001 to about 99 wt.-% of the composition.

3. The method of claim 1, wherein the fatty acid comprises in the range of about 0.0001 to about 50 wt.-% of the composition.

4. The method of claim 1, wherein the polyalkylene glycol polymer or a derivative thereof comprises in the range of about 0.001 to about 50 wt.-% of the composition, and the fatty acid comprises in the range of about 0.0001 to about 20 wt.-% of the composition.

5. The method of claim 1, wherein the polyalkylene glycol polymer or a derivative thereof comprises a homopolymer.

6. The method of claim 1, wherein the polyalkylene glycol polymer or a derivative thereof comprises a copolymer.

7. The method of claim 6, wherein the copolymer comprises a block copolymer.

8. The method of claim 6, wherein the copolymer comprises a random copolymer.

9. The method of claim 1, wherein the polyalkylene glycol polymer or derivative thereof comprises a polyethylene glycol polymer, polypropylene glycol polymer, or derivatives thereof.

10. The method of claim 9, wherein the polyalkylene glycol polymer comprises a homopolymer of polyethylene glycol, polypropylene glycol, or derivatives thereof.

11. The method of claim 9, wherein the polyalkylene glycol polymer comprises a copolymer of polyethylene glycol, polypropylene glycol, or derivatives thereof.

12. The method of claim 11, wherein the copolymer comprises a block copolymer.

13. The method of claim 12, wherein the block copolymer comprises a block copolymer of ethylene oxide and propylene oxide, and has a molecular weight in the range of about 800 to 40,000.

14. The method of claim 13, wherein the ethylene oxide comprises in the range of about 10 to 80 wt-% of the copolymer.

15. The method of claim 13, wherein the block copolymer comprises polyoxyethylene sandwiched by polyoxypropylene blocks wherein ethylene oxide constitutes from about 10 to 80 wt-% of the copolymer.

16. The method of claim 11, wherein the copolymer comprises a random copolymer.

17. The method of claim 1, wherein the container is a plastic container.

18. The method of claim 1, wherein the container is a metal container.

19. The method of claim 1, wherein the container is a glass container.

20. The method of claim 1, wherein the lubricant composition is a concentrate.

21. The method of claim 1, wherein the composition lubricant composition is a lubricant solution including a solvent/diluent.

22. The method of claim 21, wherein the solvent/diluent comprises water, methanol, ethanol, propanol, or butanol, or mixtures thereof.

23. The method of claim 1, wherein the polyalkylene glycol or derivative thereof has a molecular weight in the range of about 200 to three million.

24. The method of claim 23, wherein the polyalkylene glycol or derivative thereof has a molecular weight in the range of about 200 to about 100,000.

25. The method of claim 23, wherein the polyalkylene glycol or derivative thereof has a molecular weight in the range of about 200 to about 20,000.

26. The method of claim 23, wherein the polyalkylene glycol or derivative thereof has a molecular weight in the range of about 200 to about 10,000.

27. The method of claim 1, wherein the lubricant composition is thermoplastic compatible.

28. The method of claim 27, wherein the lubricant composition is polyethylene terephthalate compatible.

29. The method of claim 1, wherein the composition has an alkalinity level of less than about 100 ppm.

30. The method of claim 1, wherein the composition has an alkalinity level of less than about 50 ppm.

31. The method of claim 1, wherein the composition is a dry lubricant.

32. The method of claim 1, wherein the composition is a non-dripping liquid lubricant.

33. The method of claim 1, wherein the composition further comprises an additional functional ingredient.

34. The method of claim 1, wherein the lubricant composition further comprises a surfactant or mixtures thereof.

35. The method of claim 1, wherein the lubricant composition further comprises a neutralizing agent.

36. The method of claim 35, wherein the neutralizing agent is selected from the group consisting of sodium hydroxide, potassium hydroxide, monoethanolamine, diethanolamine, triethanolamine, and morpholine.

37. The method of claim 1, wherein the lubricant composition further comprises hydrogen peroxide.

38. The method of claim 1, wherein the composition is compatible with ink used on the containers.

39. A method of lubricating a moving conveyor system for transporting a container, the method comprising the step of applying a lubricant composition to a surface of a belt or track of the conveyor system, the aqueous lubricant composition comprising:

(a) in the range of about 0.001 to about 99% of of a polyalkylene glycol block copolymer or a derivative thereof; and (b) in the range of about 0.0001 to about 50 wt.-% of a fatty acid.

40. A method of lubricating a moving conveyor system for transporting a container, the method comprising the step of applying a lubricant composition to a surface of a belt or track of the conveyor system, the lubricant composition comprising:

(a) a polyalkylene glycol polymer or a derivative thereof; and (b) a fatty acid, wherein at least a portion of the fatty acid is a free fatty acid that has not been neutralized by an alkali neutralizing agent.

41. A method of lubricating a moving conveyor system for transporting a container, the method comprising the step of applying a lubricant composition to a surface of a belt or track of the conveyor system, the lubricant composition comprising:

(a) in the range of about 0.001 to about 99% or a polyalkylene glycol polymer or a derivative thereof; and (b) in the range of about 0.0001 to about 50 wt.-% of a fatty acid, wherein the composition comprises 100 ppm alkalinity or less.

42. A method of lubricating a moving conveyor system for transporting a container, the method comprising the step of applying an aqueous lubricant composition to a surface of a belt or track of the conveyor, the aqueous lubricant composition comprising:

fatty acid;

polyalkylene glycol polymer or a derivative thereof; and water, wherein the polyalkylene glycol polymer or a derivative thereof is present in the composition in an amount sufficient to solubilize/emulsify at least a portion of the fatty acid.

43. The method of claim 42, wherein the container is a plastic container.

44. The method of claim 42, wherein the container is a metal container.

45. The method of claim 42, wherein the container is a glass container.

46. The method of claim 1, wherein the lubricant composition further comprises hydrogen peroxide.

* * * * *